United States Patent [19]

Heirich

[11] 4,192,117

[45] * Mar. 11, 1980

[54] SPRING ACTION PANEL INTERLOCK

[76] Inventor: William C. Heirich, 2912 Wauhilah Dr., Muskogee, Okla. 74401

[ * ] Notice: The portion of the term of this patent subsequent to May 30, 1995, has been disclaimed.

[21] Appl. No.: 907,196

[22] Filed: May 18, 1978

Related U.S. Application Data

[63] Continuation of Ser. No. 798,104, May 18, 1977, Pat. No. 4,091,588.

[51] Int. Cl.[2] ..... E04B 5/52

[52] U.S. Cl. ..... 52/478; 52/522; 52/542; 52/588

[58] Field of Search ..... 52/519, 520, 522, 529, 52/537, 519, 542, 588, 478, 543, 521, 530, 531

[56] References Cited

U.S. PATENT DOCUMENTS

| | | | |
|---|---|---|---|
| 1,706,924 | 3/1929 | Kane | 52/542 X |
| 3,394,524 | 7/1968 | Howarth | 52/588 |
| 3,481,094 | 12/1969 | Taylor | 52/522 X |
| 3,568,388 | 3/1971 | Flachbarth | 52/588 |
| 3,603,057 | 9/1971 | Cussan | 52/478 |
| 3,733,767 | 5/1973 | Csaik | 52/588 X |
| 4,091,588 | 5/1978 | Heirich | 52/478 |

*Primary Examiner*—James A. Leppink
*Assistant Examiner*—Carl D. Friedman
*Attorney, Agent, or Firm*—Staas & Halsey

[57] ABSTRACT

A paneling system having a supporting member and a plurality of panels each of which is provided at the ends thereof with interlocking flanges, the interlocking flange located at one end of the panel having a portion extending from the panel to the supporting member engaging same and thereafter extending away from the supporting member terminating in an end that is positioned in spaced relationship from the remainder of the flange, a fastener securing the flanges to the supporting member, and wherein the interlocking flange at the other end of the panel has a portion extending from the panel which engages only a part of the corresponding portion of the other interlocking flange extending to a point near the supporting member and thereafter backwardly toward the end of the other interlocking flange terminating in an end which engages the end of the other interlocking flange.

4 Claims, 5 Drawing Figures

SPRING ACTION PANEL INTERLOCK

This is a continuation of application Ser. No. 798,104, filed May 18, 1977, now U.S. Pat. No. 4,091,588.

BACKGROUND AND SUMMARY OF THE INVENTION

The present invention relates to a system for locking adjacently positioned panels together and for suspending the assembled panels from a supporting member. A wide variety of techniques have been used in the past to install panels to overhead supporting structure, including by way of example, panels which are provided with locking flanges configured such that after the flanges of adjacent panels are aligned one of the panels is rotated relative to the other to lock the panels in place. Clips extending downwardly from the supporting member have sometimes been used to secure the adjacent flanges of the panels to the supporting member. In addition to the foregoing, the panels are sometimes fastened directly to the overhead supporting structure with the use of self-drilling fasteners. With these and other known panel locking systems in mind it is apparent that with the spring action panel interlock of the present invention it is possible to accomplish the following objectives believed to be heretofore unavailable. With the present invention, adjacent panels may be interlocked with only "linear" motion by merely urging the male flange of one panel into engagement within the female flange of an adjacent panel. Thus, the necessity of having to swing one panel over the other, or to use clips, or to pre-drill the support before beginning to assemble the panels, is eliminated. Moreover, with the present invention simple screw-type fasteners may be used to secure the panels to the overhead supporting structure from a position below the structure thus avoiding the necessity of having to work on top of the supporting structure. In addition, with the panel interlock of the present invention only very slight pressure by the hand is necessary to "snap" the interlocking flanges of adjacent panels together. But once assembled, the panels cannot unlock by reverse action under downward pressure since increasing the load on the panels results only in forcing the interlocking flanges into tighter engagement. This procedure of interlocking with only slight pressure while providing a fail-safe system against unlocking is applicable over a wide range of dimensional tolerances thus avoiding the necessity of precise orientation of the components of the interlocking system. Still further, the snap-action panel interlock of the present invention is suitable for use with a reinforcing member positioned between the interlocking flanges of adjacent panels for increasing substantially both the load bearing and spanning capability of the assembled panel system.

The foregoing advantages are accomplished with the spring action panel interlock of the present invention which features a first interlocking female flange of one panel that has a portion which extends from the panel to the supporting member, another portion that extends along the supporting member engaging same such that a fastener can secure this portion directly to the supporting member, and another portion that extends away from the supporting member terminating in an end which is spaced from the other portions of the flange and which is provided with a lip. The other interlocking male flange of an adjacent panel has a portion which extends from the panel and which engages only a part of the corresponding portion of the other flange so as to reduce the friction therebetween permitting longitudinal sliding of adjacent panels, and another portion which extends diagonally backwardly terminating in an end which engages the lip of the other flange. Under increased loading, the interlocked panels are forced into even tighter relationship as a result of the diagonally positioned portion of the male flange being forced into a position generally perpendicular to the remainder of the flange thus causing the end of the male flange to force the lip of the female flange outwardly.

DESCRIPTION OF THE PREFERRED EMBODIMENT

Figure 1:
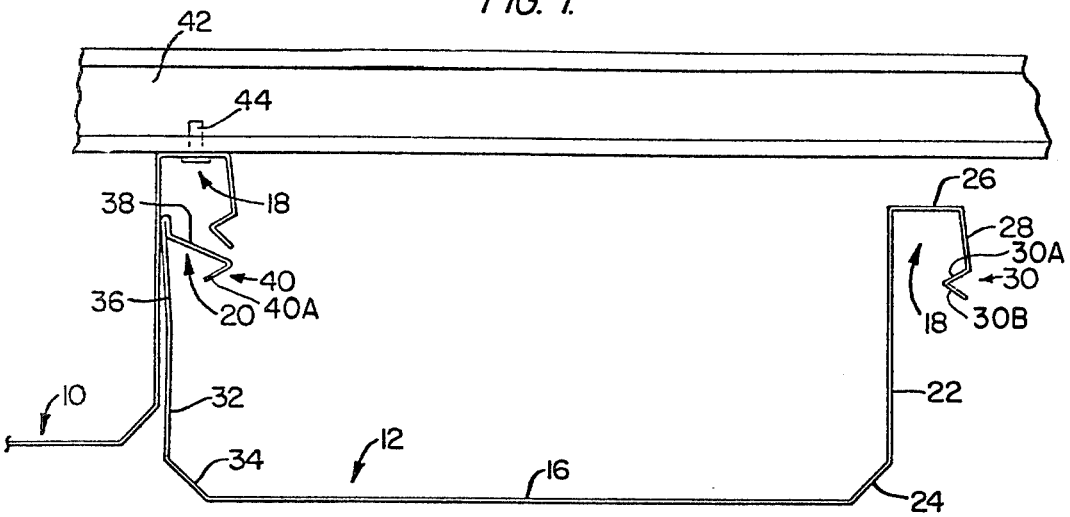
FIG. 1 is an end view of one of the panels illustrating the construction of the interlocking flanges formed at each end thereof, and the position of the panel just before being urged upwardly into engagement with the other panel which has been fastened to the supporting member.
Figure 2:
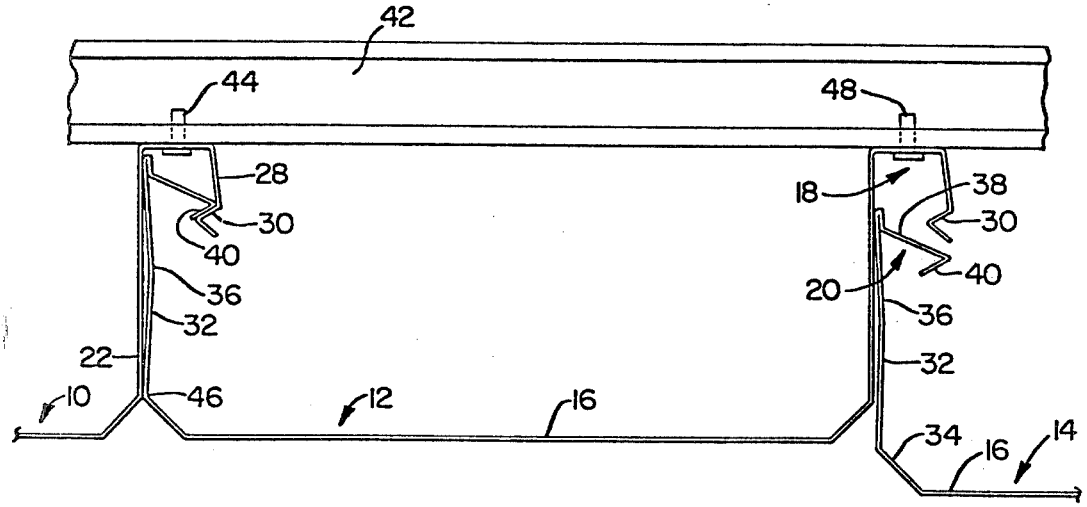
FIG. 2 is an end view of the panel snap-fitted in place, and a portion of another panel ready to be urged upwardly into engagement therewith.
Figure 3:
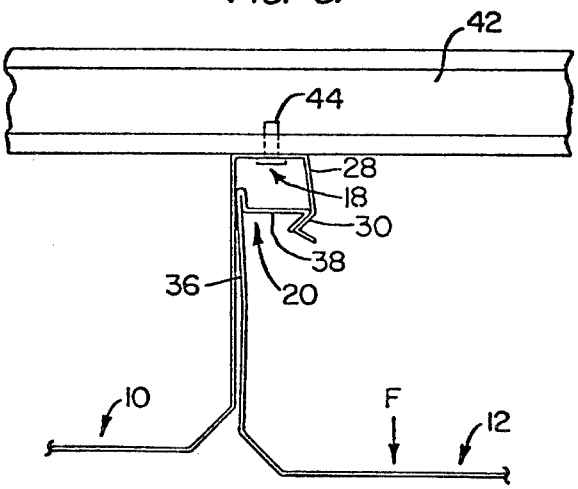
FIG. 3 is an end view of the interlocking flanges of adjacent panels illustrating movement of the diagonal portion of the male flange into tighter engagement with the female flange as pressure is applied to the panel.

The spring action panel interlocking system of the present invention is illustrated in FIGS. 1–2, wherein the reference numerals 10, 12 and 14 designate adjacent panels. The panels 10, 12 may be flat as illustrated in FIGS. 1–3 or curved as designated by the reference numerals 10', 12' in FIG. 4. Each of the panels consists of a wall 16 which may be flat or curved and which ternimates in interlocking flanges 18 and 20. The interlocking flange 18 is provided with a first section 22 that extends outwardly from the wall 16, it being apparent that the section 24 joins the section 22 to the wall 16 such that the section 22 is generally perpendicular to the wall 16. The flange 18 is also provided with a second section 26 that extends outwardly from the section 22 and which is generally perpendicular to the section 22. The flange 18 is also provided with a third section 28 that extends outwardly from the section 26 forming an angle with the section 26 which is approximately 90 degrees. The section 28 terminates in a lip 30. Since each of the panels 10, 12 and 14 is formed of a flexible material, for example, roll formed aluminum, it is apparent that the sections 22, 26 and 28 of the interlocking flange 18 are free to flex, as described hereinafter.

The interlocking flange 20 of each of the panels 10, 12 and 14 is provided with a fourth section 32 which extends outwardly from the wall 16, it being apparent that a section 34 joins the section 32 to the wall 16. A fifth section 36 extends from the section 32 such that the included angle between the sections 32 and 36 is slightly less than 180°. It will be apparent from the foregoing that when the sections 32 and 36 of the male interlocking flange 20 are positioned adjacent the section 22 of the female interlocking flange 18 only portions of the sections 32 and 36 engage the section 22. (See the space between flange sections 22, 32 and 36 in FIG. 2, for example) Each of the interlocking flanges 20 is provided with a sixth section 38 which extends diagonally from the section 36 terminating in a lip 40. It will be apparent from FIG. 2 that when the interlocking flanges 18 and 20 are assembled, the lip 40 of the section 38 engages the point of intersection of the section 28 and lip 30 of the interlocking flange 18.

Installation of the panels will now be described with reference to FIGS. 1–2. It will be apparent from FIG. 1 that the interlocking flange 18 of the panel 10 has been fastened to the overhead beam 42 with the fastener 44 which may, for example, be a self-drilling screw. The installer then positions the interlocking flange 20 of the next panel 12 immediately below the interlocking flange 18 of the mounted panel 10 and pushes upwardly thereon. The pressure of the male interlocking flange 20 against the female interlocking flange 18 causes the section 28 and lip 30 of the interlocking flange 18 to spring outwardly as the diagonal section 38 of the interlocking flange 20 springs downwardly and the sections 32 and 36 of the interlocking flange 20 spring inwardly towards the section 22 of the interlocking flange 18. Eventually, the lip 40 of the male flange 20 passes over the lip 30 of the female flange 18 at which time the sections of the interlocking flanges 18 and 20, as previously described, resume their original position.

It will be apparent that precise alignment of the fronts and rears of adjacent of the panels 10, 12 and 14 is unnecessary since after the interlocking flanges 20 have been inserted within the interlocking flanges 18 adjacent of the panels 10, 12 and 14 may be slided longitudinally relative to each other. Note further that since the sections 32 and 36 of the interlocking flange 20 intersect at an angle slightly less than 180° the result is to reduce the areas of the sections 32 and 36 which engage the section 22 thus reducing friction between the interlocking flanges 18 and 20. Reducing friction, of course, permits ease in longitudinal adjustment of the assembled panels. Moreover, the angular relationship between the sections 32 and 36 of the interlocking flange 20 limits the contact between the sections 32 and 22 to the area generally designated by the reference numeral 46 which results in reducing the tendency of the panels to have a "gap" between the adjacent sections 22 and 32, particularly if one of the sections is bent.

Once the panel 12 is snap-fitted to the panel 10, the interlocking flange 18 of the panel 12 is secured to the overhead beam 42 with the fastener 48, as illustrated in FIG. 2, afterwhich the next panel 14 is secured in place by snapping the male interlocking flange 20 of the panel 14 within the female interlocking flange 18 of the panel 12. It will now be apparent that the fasteners 44 and 48 are hidden from view.

The "fail-safe" feature of the panel interlock of the present invention is illustrated in FIG. 3 wherein the interlocking flanges 18 and 20 of the adjacent panels 10 and 12 are shown in locked position. FIG. 3 illustrates how the interlocking flanges 18 and 20 resist unlocking under downward force F despite the fact that only minimal hand pressure is required to lock the interlocking flanges 18 and 20. When force F is applied to the panel 12 the interlocking flanges 18 and 20 resist unlocking as the interlocking flange 20 is forced into even tighter engagement with the interlocking flange 18, eventually resulting in the section 38 of the flange 20 being forced into a position generally perpendicular to the section 36 thereof and the section 28 and lip 30 of the flange 18 being forced outwardly. Thus, the panel 12 cannot unlock from the panel 10 unless and until the flanges 18 and 20 have distorted beyond that position illustrated in FIG. 3.

With the foregoing in mind, certain of the advantages of the spring action panel interlock of the present inention will be described. The adjacent panels 10, 12 and 14 are interlocked with a simple upward linear motion as distinguished from the swing-over motion that is frequently used. That is, during installation it is only necessary to push the panel upwardly into locking relationship with respect to a panel that has already been assembled. The panels 10, 12 and 14 may be attached to the overhead structure 42 with screw-type fasteners 44 and 48 from below, thus avoiding the necessity of working on top of the overhead supporting structure 42. Only easy hand pressure is required for snapping the interlocking flanges 18 and 20 together. While construction time and effort are significantly reduced, the arrangement of the sections of the interlocking flanges of the invention define a "fail-safe" interlock precluding the unlocking of adjacent interlocking flanges under downward pressure. Still further, after the interlocking flanges 18 and 20 are assembled by snapping in place, the adjacent panels 10, 12 and 14 may be easily moved longitudinally by sliding action because friction has been minimized by the angular relationship of the sections 32 and 36 relative to the section 22.

Figure 4:
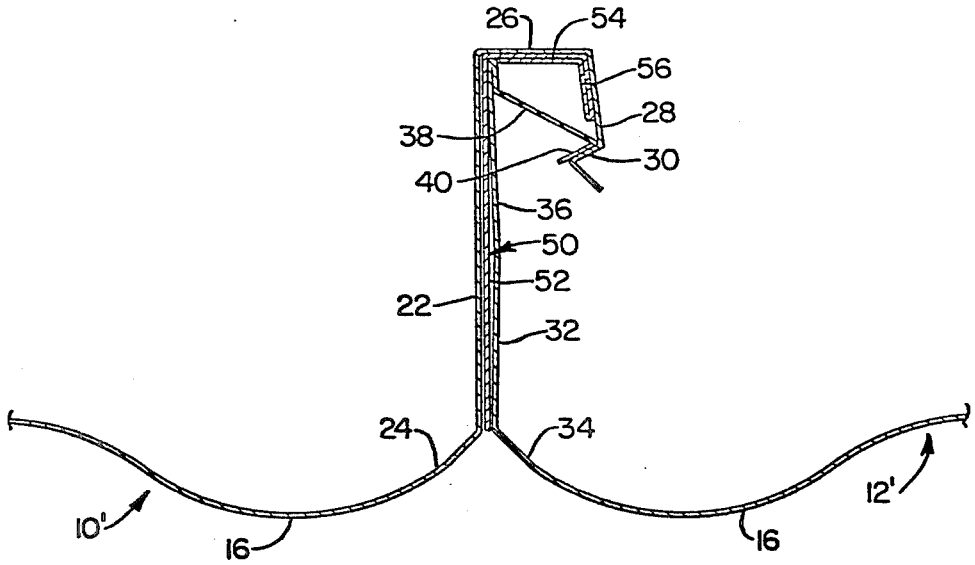
FIG. 4 is a sectional view taken along line 4—4 of FIG. 5 illustrating the interlocking flanges of adjacent panels with a reinforcing member positioned therebetween to increase the load bearing and spanning capability of the assembled panels.
Figure 5:
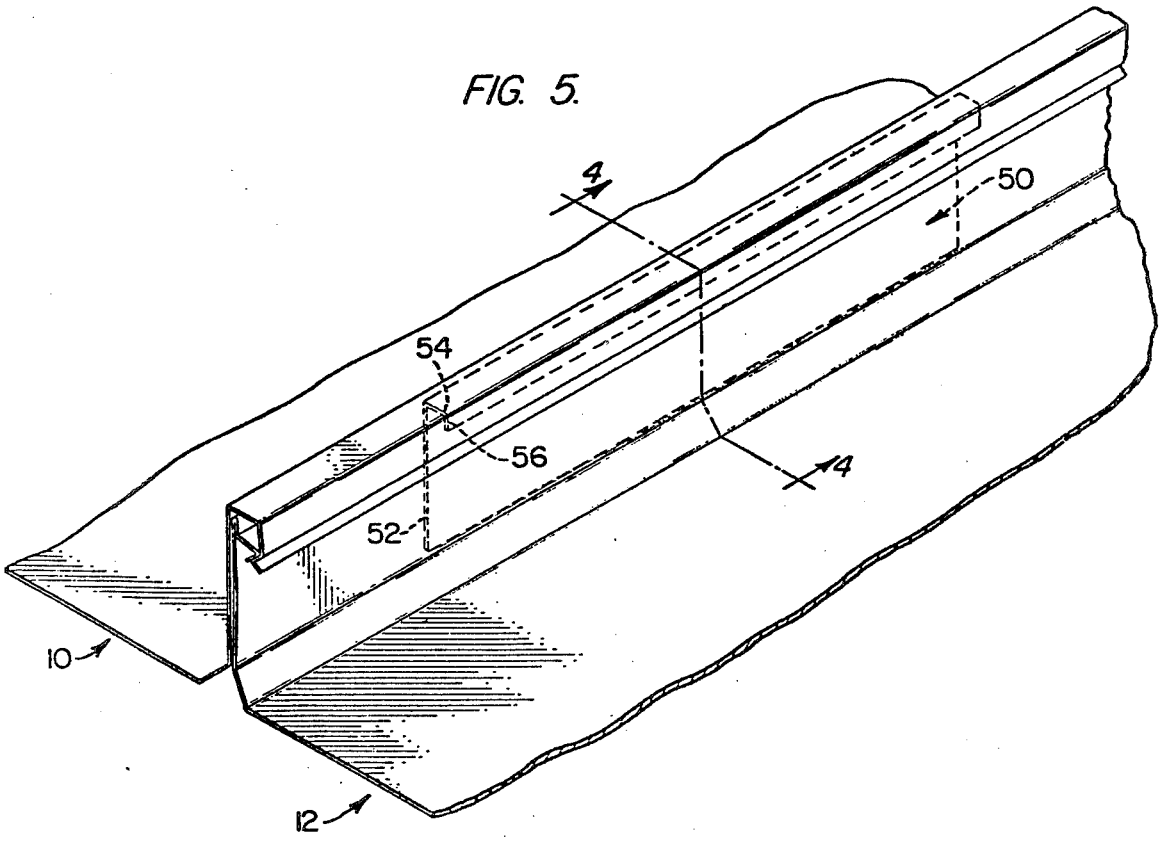
FIG. 5 is a perspective view of the interlocking flanges of adjacent panels with the reinforcing member shown in dotted lines positioned only at the central portion of the panels.

Turning now to FIGS. 4–5, the reference numeral 50 designates generally a reinforcing member that may be positioned within the interlock previously described for the purpose of increasing both the load bearing and spanning capability of the assembled panels 10 and 12. In this connection, it should be noted that flat bottom panels are not as strong under downward loading as structural type panels of comparable gauge metal. This is true because flat panels have considerably less metal under compression in their upper flange areas than do structural panels. Thus, it is necessary to use substantially heavier gauge metal in flat panels than in structural type panels to obtain equivalent loading capacity. But with reinforcing member 50, which is inserted between the interlocking flanges 18 and 20, it is possible to increase the amount of metal that is in a state of compression under loading and thus significantly increase the potential loading and span capability of a given gauge panel, with the additional economic advantage of not having to increase the gauge of metal throughout the entire panel.

As illustrated in FIG. 4, the reinforcing member 50 consists of a section 52 which is positioned between the sections 32 and 36 of the flange 20 and the section 22 of the flange 18, and a section 54 which extends outwardly from the section 52 and which rests against the section 26 of the flange 18. The section 56 of the reinforcing member 50 extends outwardly from the section 54 and rests in abutting relationship against part of the section 28 of the flange 18. As illustrated in FIG. 4, the sections 54 and 56 may comprise portions of the reinforcing member 50 that are "folded" together.

Moreover, and as illustrated in FIG. 5, it is not necessary to have the reinforcing member 50 extend the entire length of th panels 10 and 12 because under extreme loading the adjacent panels 10 and 12 will fail by compressive buckling of the adjacent flanges 18 and 20 at the center of the span of the panels. Thus, optimum results may be obtained by running the reinforcing member 50 over the center one-half or one-third of the span of the panels 10 and 12.

I claim:

1. In a paneling system having a supporting member defining a plane and a plurality of flexible panels connected to each other and to said supporting member, the improvement comprising a first of said plurality of panels having a main section, a first section extending from one end of said main section along a plane that is substantially perpendicular to said plane of said supporting member, a second section extending from said first section and resting against said supporting member, a fastener attaching said second section to said supporting member, a third section extending from said second section away from said supporting member and defining a channel in conjunction with said first and second sections, a lip formed at the end of said third section having a first leg extending from said third section toward said first section along a plane that intersects the plane of said first section and a second leg extending from the end of said first leg away from said first section along a plane that intersects the plane of said first section, and a second of said plurality of panels adjacent and locked to said first of said plurality of panels having a main section, a first section extending from one end of said main section to said supporting member and abutting said first section of said first panel, a second section extending from said first section along a plane that intersects the planes of said first section and said third section of said first panel, a lip formed at the end of said second section of said second panel including a leg that extends toward said first section of said second panel along a plane that corresponds to said plane of said first leg of said lip of said first panel.

2. A paneling system as in claim 1, further comprising a reinforcing member having a portion positioned between said first sections of said first and second panels and a portion engaging said second and third sections of said first panel, said reinforcing member extending along a part of the length of said first and second panels.

3. A paneling system, comprising:

a supporting member defining a plane;

a first panel having a central wall, a side wall extending upwardly from said central wall and terminating in a female locking flange having a first section lying along a plane that intersects the plane of said supporting member, a second section engaging said supporting member and attached thereto with a fastener, and a third section extending downwardly away from said supporting member and terminating in a lip including a first leg extending towards said first section and a second leg extending away from said first section;

a second panel having a central wall, a side wall extending upwardly from said central wall and terminating in a male locking flange consisting of a first section lying along a plane that intersects the plane of said supporting member, a second section extending downwardly from said first section terminating in a lip including a leg that extends toward said first section of said male locking flange along a plane;

wherein said male flange of said second panel is locked to said female flange of said first panel by aligning said first section of said male flange with said first section of said female flange and thereafter exerting an upward force on said second panel until said second section of said male flange abuts said second leg of said female flange, continuing to exert an upward force against said second panel causing said third section and said lip of said female flange to be forced outwardly away from said first section thereof and said second section and said lip of said male flange to be forced downwardly towards said first section thereof until said male flange snaps in place within said female flange at which time said planes of said first leg of said female flange and said lip of said male flange coincide; and wherein a downward load on said second panel results in forcing said second section and lip of said male flange into tighter engagement with said third section and lip of said female flange precluding unlocking by reverse action.

4. A panel, comprising a central wall, a side wall extending outwardly from one end of said central wall and terminating in a female locking flange havng a first section, a second section extending outwardly from said first section, and a third section extending outwardly from said second section on the same side as said first section and terminating in a lip including a first leg extending toward said first section and second leg extending away from said first section, a side wall extending outwardly from the other end of said central wall and terminating in a male locking flange consisting of a first section that is complementary in configuration with respect to said first section of said female locking flange a second section extending from said first section towards said central wall a distance along a plane generally corresponding to the distance along the plane between the intersection of said first and second sections of said female flange and the intersection of said third section and said lip of said female flange, a lip formed at the end of said second section lying along a plane that is parallel to said first leg of said lip of said female locking flange, said lip of said female locking flange and said first leg of said male locking flange being positioned the same distance from said central wall.

* * * * *